US012735290B2

(12) United States Patent
Kishimoto et al.

(10) Patent No.: US 12,735,290 B2
(45) Date of Patent: Sep. 15, 2026

(54) SHEET POST-PROCESSING APPARATUS AND IMAGE FORMING SYSTEM

(71) Applicant: KYOCERA Document Solutions Inc., Osaka (JP)

(72) Inventors: Tadahisa Kishimoto, Osaka (JP); Satoru Yonemoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 148 days.

(21) Appl. No.: 18/965,345

(22) Filed: Dec. 2, 2024

(65) Prior Publication Data

US 2025/0187863 A1 Jun. 12, 2025

(30) Foreign Application Priority Data

Dec. 7, 2023 (JP) ..... 2023-206645

(51) Int. Cl.
*B65H 29/60* (2006.01)

(52) U.S. Cl.
CPC ..... *B65H 29/60* (2013.01); *B65H 2801/27* (2013.01)

(58) Field of Classification Search
CPC ..... B65H 29/58; B65H 29/60; B65H 31/22; B65H 2801/27; B65H 2402/31; B65H 2402/441; B65H 2601/321; B65H 2404/1521; B65H 2404/2615
USPC ..... 399/110, 124; 270/58.18
See application file for complete search history.

(56) References Cited

U.S. PATENT DOCUMENTS

| | | | | |
|---|---|---|---|---|
| 4,352,490 | A * | 10/1982 | Hatakeyama | B65H 29/60 271/289 |
| 6,250,631 | B1 | 6/2001 | Hanamoto et al. | 271/298 |
| 7,976,021 | B2 * | 7/2011 | Matsuo | G03G 15/6552 271/305 |
| 12,172,857 | B2 * | 12/2024 | Ogawa | B65H 29/60 |
| 12,577,075 | B2 * | 3/2026 | Yonemoto | B65H 29/60 |
| 2010/0001462 | A1 * | 1/2010 | Matsuo | B65H 29/58 271/305 |

FOREIGN PATENT DOCUMENTS

JP 2000-169033 A 6/2000

* cited by examiner

*Primary Examiner* — Leslie A Nicholson, III
(74) *Attorney, Agent, or Firm* — Stein IP, LLC

(57) ABSTRACT

A sheet post-processing apparatus includes a post-processing main unit and an expansion unit. The expansion unit, into which a sheet having passed through the post-processing main unit is introduced, is removably mounted on the post-processing main unit. The post-processing main unit includes a switching guide that switches the conveyance direction of the sheet between a first direction leading to a main-unit discharge tray and a second direction leading to the expansion unit. The expansion unit includes a guide contact member that, when the expansion unit is mounted on the post-processing main unit, makes contact with the switching guide to switch the switching guide to a position for the second direction.

7 Claims, 12 Drawing Sheets

SHEET POST-PROCESSING APPARATUS AND IMAGE FORMING SYSTEM

INCORPORATION BY REFERENCE

This application is based on and claims the benefit of priority from Japanese Patent Application No. 2023-206645 filed on Dec. 7, 2023, the contents of which are hereby incorporated by reference.

BACKGROUND

The present disclosure relates to a sheet post-processing apparatus that performs post-processing on a sheet having an image formed on it by the image forming apparatus, and relates also to an image forming system provided with such a sheet post-processing apparatus.

SUMMARY

There are known sheet post-processing apparatuses that perform post-processing, such as binding and folding, on sheets having images formed on them by an image forming apparatus such as a copier or printer. Such sheet post processing apparatuses are often configured so that a variety of expansion units with different functions are removably mountable on them.

According to one aspect of the present disclosure, a sheet post-processing apparatus includes a post-processing main unit and an expansion unit. The post-processing main unit performs predetermined post-processing on a sheet and discharges the sheet to a main-unit discharge tray. The expansion unit, into which the sheet having passed through the post-processing main unit is introduced, is removably mounted on the post-processing main unit. The post-processing main unit includes a switching guide that switches the conveyance direction of the sheet passing through the post-processing main unit between a first direction leading to the main unit discharged tray and a second direction leading to the expansion unit. The expansion unit includes a guide contact member that, when the expansion unit is mounted on the post-processing main unit, makes contact with the switching guide to switch the switching guide to a position for the second direction.

DETAILED DESCRIPTION

An embodiment of the present disclosure will be described below with reference to the accompanying drawings. The scope of the present disclosure is not limited to what is described herein.

Figure 1:
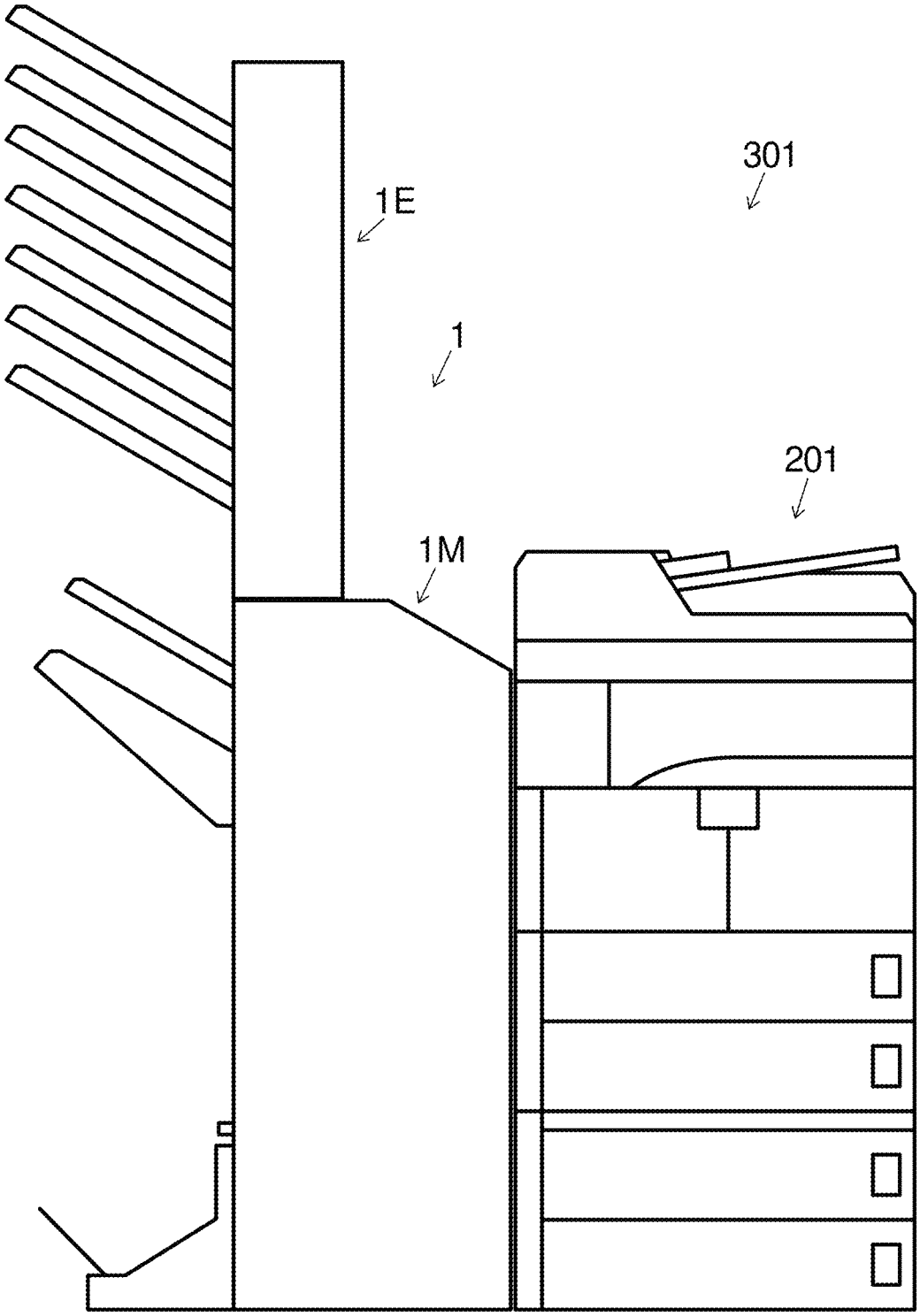
FIG. 1 is a front view of an image forming system according to one embodiment of the present disclosure.

FIG. 1 is a front view of an image forming system 301 according to one embodiment. As shown in FIG. 1, the image forming system 301 includes an image forming apparatus 201 and a sheet post-processing apparatus 1.

The image forming apparatus 201 is, for example, what is called a monochrome-printing multifunction peripheral that has an electrophotographic printing mechanism and that has functions such as printing, scanning (image reading), and facsimile transmission. The image forming apparatus 201 can be, for example, an apparatus such as a copier or printer, and can be a color-printing apparatus.

The image forming apparatus 201 includes an image forming section, a transfer section, and a fixing section (none is shown). In the image forming section, an electrostatic latent image of a document image formed on the surface of a photosensitive drum with laser light is supplied with toner to be developed to form a toner image of the document image. The transfer section transfers the toner image formed on the surface of the photosensitive drum to a sheet. The fixing section heats and presses the sheet having the toner image transferred to it to fix the toner image to the sheet. In this way, the image forming apparatus 201 forms (prints) an image on the sheet. The image forming apparatus 201 then conveys the sheet after image formation to the sheet post-processing apparatus 1.

The sheet post-processing apparatus 1 is removably coupled to a side face of the image forming apparatus 201. The sheet post-processing apparatus 1 can be coupled in a similar manner to devices other than multifunction peripherals, such as copiers and printers. The sheet post-processing apparatus 1 performs predetermined post-processing on the sheet having undergone image formation (printing) in the image forming device 201.

As shown in FIG. 1, the sheet post-processing apparatus 1 includes a post-processing main unit 1M and an expansion unit 1E. The post-processing main unit 1M performs the predetermined post-processing on sheets and discharges the sheets to a first discharge tray 33, a second discharge tray (main-unit discharge tray) 53, or a third discharge tray 73, which will be described later. The expansion unit 1E is removably mounted on the post-processing main unit 1M, and sheets that have passed through the post-processing main unit 1M enter it.

Figure 2:
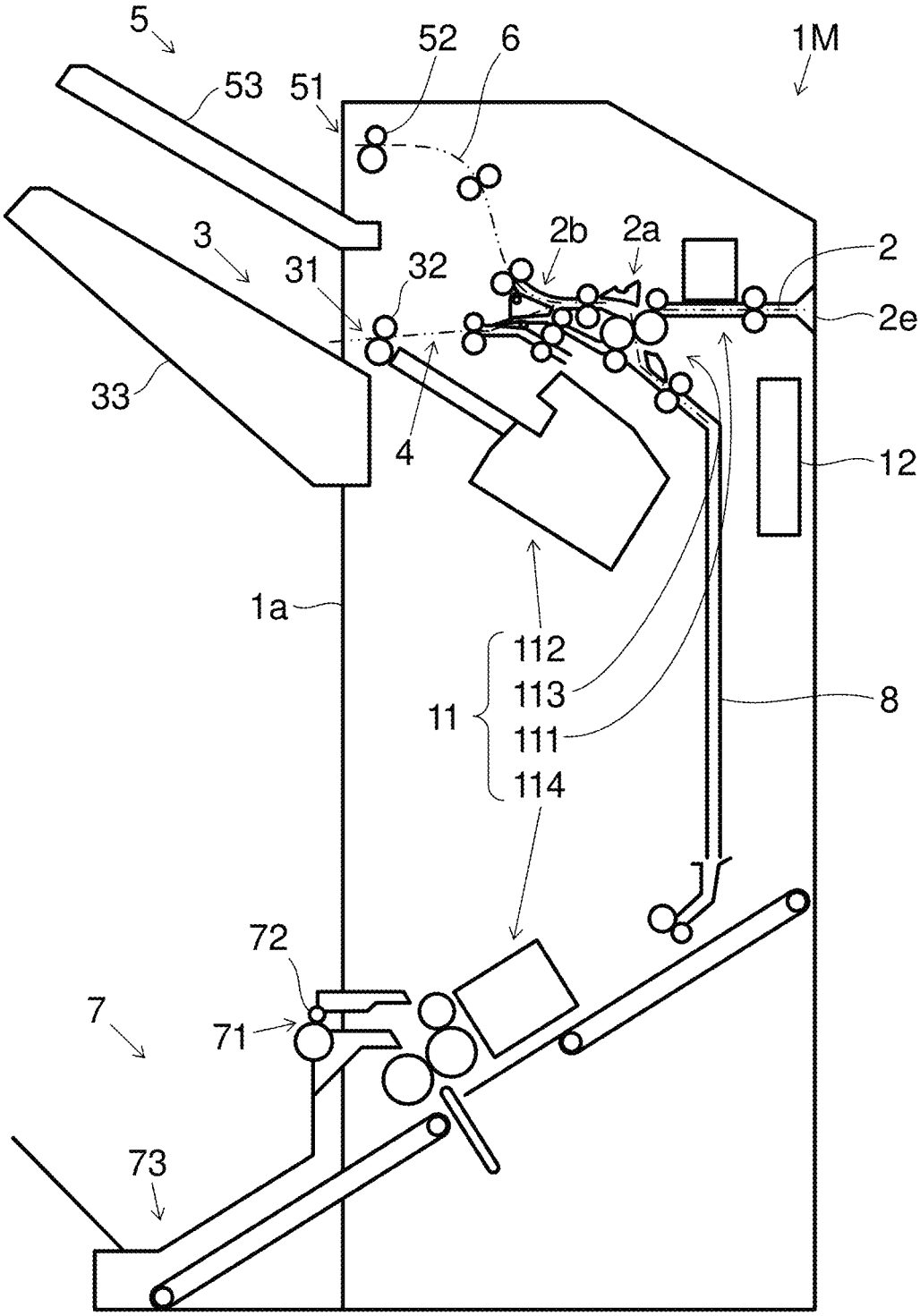
FIG. 2 is a schematic sectional front view of a post-processing main unit of a sheet post-processing apparatus in FIG. 1.

FIG. 2 is a schematic sectional front view of the post-processing main unit 1M of the sheet post-processing apparatus 1 shown in FIG. 1. As shown in FIG. 2, the post-processing main unit 1M includes a sheet introduction passage 2, a first sheet discharge section 3, a first sheet discharge passage 4, a second sheet discharge section 5, a second sheet discharge passage 6, a third sheet discharge section 7, a third sheet discharge passage 8, a post-processing section 11, and a post-processing control section 12.

The sheet introduction passage 2 has a sheet introduction port 2*e*. The sheet introduction port 2*e* is provided in the side face of the sheet post-processing apparatus 1 facing the image forming apparatus 201 and has an opening. Sheets conveyed from the image forming apparatus 201 to the sheet post-processing apparatus 1 are fed into the sheet post-processing apparatus 1 through the sheet introduction port 2*e* and the sheet introduction passage 2. The sheet introduction passage 2 extends in a generally horizonal direction, in a direction away from the image forming apparatus 201 (leftward in FIG. 2), from the sheet introducing port 2*e* to a sheet folding section 113, which will be described later. The sheet introduction passaged 2 has a first branch section 2*a* and a second branch section 2*b,* which are disposed in this order from upstream (from the sheet introducing passage 2*e* side) in the sheet conveyance direction.

With respect to the sheet conveyed downstream from the sheet introduction port 2*e*, the first branch section 2*a* switches the sheet conveyance direction between a direction leading to the first and second sheet discharge sections 3 and 5 and a direction leading to the third sheet discharge section 7. With respect to the sheet conveyed downstream from the sheet introduction port 2*e,* the second branch section 2*b* switches the sheet conveyance direction between a direction leading to the first sheet discharge section 3 and a direction leading to the second sheet discharge section 5.

The first sheet discharge section 3 is provided on the side face 1*a* of the sheet post-processing apparatus 1 opposite from its side facing the image forming apparatus 201. The first sheet discharge section 3 has a first discharge port 31, a pair of first discharge rollers 32, and a first discharge tray 33.

The first discharge port 31 is located at the downstream end of the first sheet discharge passage 4 in the sheet discharge direction. The pair of first discharge rollers 32 is located at the first discharge port 31. The first discharge tray 33 is located downstream of the first discharge port 31 in the sheet discharge direction. A sheet conveyed through the first sheet discharge passage 4 and having reached the first discharge port 31 is discharged by the pair of the first discharge rollers 32 through the first discharge port 31 onto the first discharge tray 33.

The first sheet discharge passage 4 is continuous from the downstream end of the sheet introduction passage 2 in the sheet discharge direction and extends in a generally horizontal direction, in a direction away from the image forming apparatus 201 (leftward in FIG. 2), to the first sheet discharge section 3.

The second sheet discharge section 5 is provided on the side 1*a* of the sheet post-processing apparatus 1, above the first sheet discharge section 3. The second sheet discharge section 5 has a second discharge port 51, a pair of second discharge rollers 52, and a second discharge tray (main-unit discharge tray) 53.

The second discharge port 51 is located at the downstream end of the second sheet discharge passage 6 in the sheet discharge direction. The pair of second discharge rollers 52 is located at the second discharge port 51. The second discharge tray 53 is located downstream of the second discharge port 51 in the sheet discharge direction. A sheet conveyed through the second sheet discharge passage 6 and having reached the second discharge port 51 is discharged by the pair of second discharge rollers 52 through the second discharge port 51 onto the second discharge tray 53.

The second sheet discharge passage 6 branches from the second branch section 2*b* located in a downstream part of the sheet introduction passage 2 in the sheet discharge direction and extends laterally upward in a direction away from the image forming apparatus 201 (leftward in FIG. 2) up to the second sheet discharge section 5.

The third sheet discharge section 7 is provided on the side face 1*a* of the sheet post-processing apparatus 1, below the first sheet discharge section 3. In other words, the third sheet discharge section 7 is disposed near a bottom part of the sheet post-processing apparatus 1. The third sheet discharge section 7 has a third discharge port 71, a pair of third discharge rollers 72, and a third discharge tray 73.

The third discharge port 71 is located at the downstream end of the third sheet discharge passage 8 in the sheet discharge direction. The pair of third discharge rollers 72 is disposed at the third discharge port 71. The third discharge tray 73 is located downstream of the third discharge port 71 in the sheet discharge direction. A sheet conveyed through the third sheet discharge passage 8 and having reached the third discharge port 71 is discharged by the pair of third discharge rollers 72 through the third discharge port 71 onto the third discharge tray 73.

The third sheet discharge passage 8 branches from the first branch section 2*a* located in a downstream part of the sheet introduction passage 2 in the sheet discharge direction and extends downward down to the third sheet discharge section 7.

The post-processing section 11 performs predetermined processing on sheets that have undergone image formation by the image forming apparatus 201 and that have then been fed into the sheet post-processing apparatus 1. The post-processing section 11 includes a perforation section 111, a stapling section 112, a sheet folding section 113, and a bookbinding section 114.

The perforation section 111 is disposed in the sheet introduction passage 2, closely downstream of the sheet introduction port 2*e*. The perforation section 111 can perform a perforation process on a sheet being conveyed on the sheet introduction passage 2 to form a punch hole in it.

The stapling section 112 is disposed below the first sheet discharge passage 4, near the first sheet discharge section 3. The stapling section 112 can perform a stapling process (binding process) on a sheet bundle formed by stacking together multiple sheets to bind the sheet bundle.

The sheet folding section 113 is disposed downstream of the perforation section 111, upstream of the stapling section 112, with respect to the sheet transport direction in the sheet introduction passage 2. The sheet folding section 113 can perform a folding process to a sheet to form a crease in it.

The bookbinding section 114 is disposed in a downstream part of the third sheet discharge channel 8 in the sheet discharge direction, near the third sheet discharge section 7. The bookbinding section 114 can perform a middle-folding process and a middle-binding process to a sheet bundle formed by stacking together multiple sheets to fold and bind it generally at the middle and thereby form a booklet.

The post-processing control section 12 includes a CPU, an image processing section, a memory section, and other electronic circuits and electronic components (none is shown). The post-processing control section 12 is communicatively connected to an image forming control section (not shown) in the image forming apparatus 201. The post-processing control section 12 receives instructions from the image forming control section and performs processing related to the functions of the sheet post-processing apparatus 1 by controlling the operation of the individual components in the sheet post-processing apparatus 1 using the CPU and based on control programs and data stored in the memory section. The sheet introduction passage 2, the first sheet discharge section 3, the first sheet discharge passage 4, the second sheet discharge section 5, the second sheet discharge passage 6, the third sheet discharge section 7, the third sheet discharge passage 8, and the post-processing section 11 individually receive instructions from the post-processing control section 12 and operate together to perform post-processing on sheets. The functions of the post-processing control unit 12 can be assumed by the image forming control section in the image forming apparatus 201.

Figure 3:
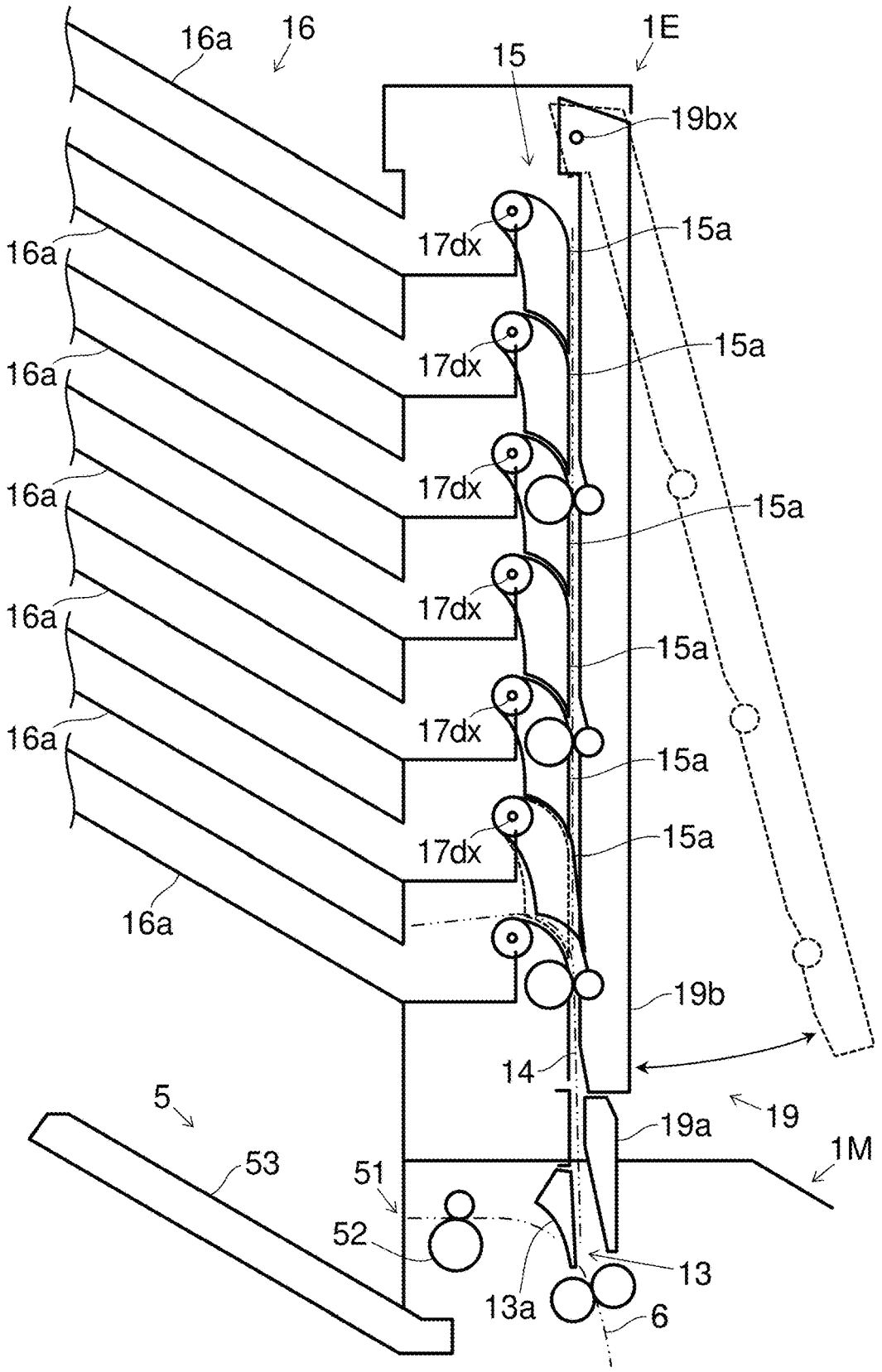
FIG. 3 is a schematic sectional front view of an expansion unit of the sheet post-processing apparatus in FIG. 1.
Figure 4:
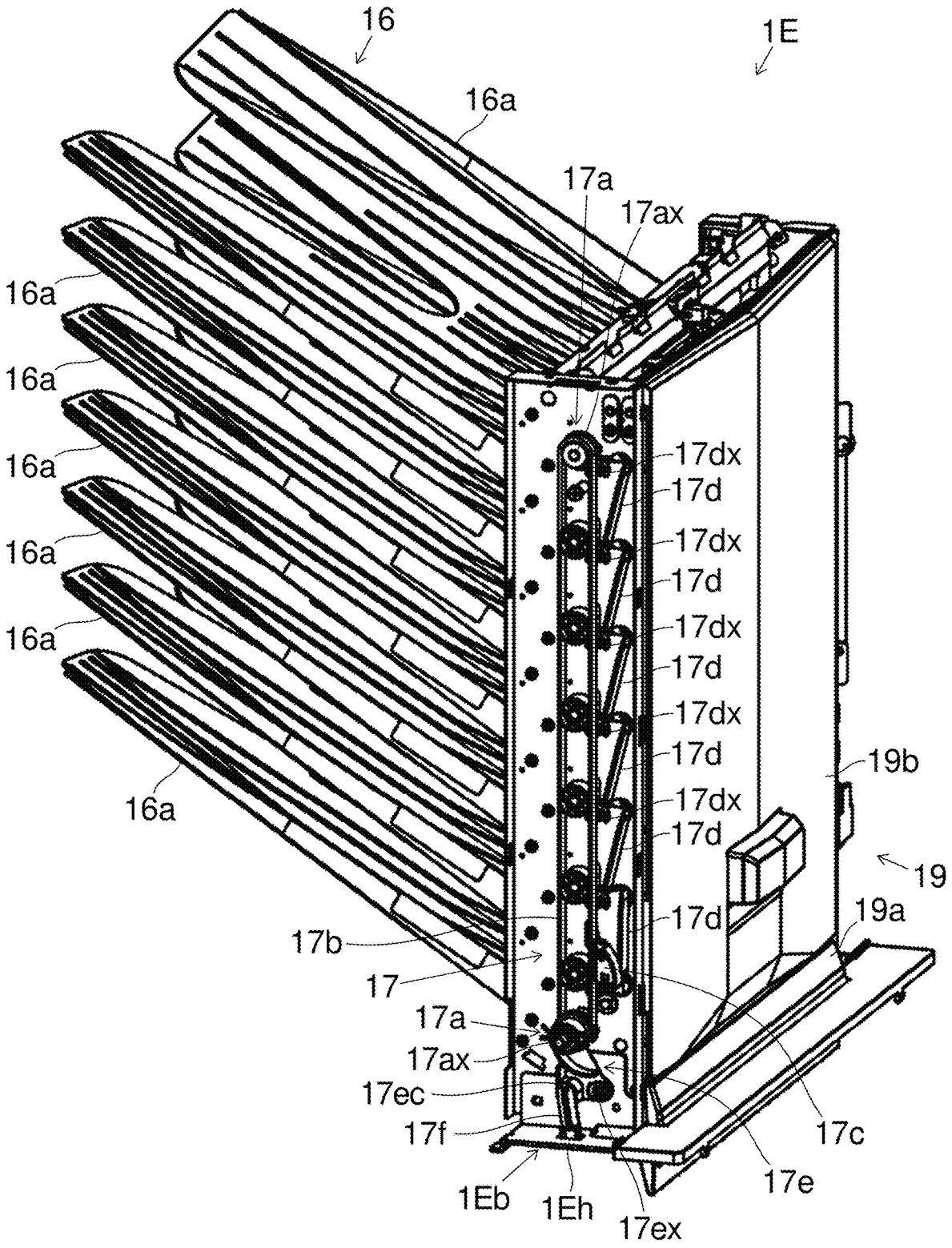
FIG. 4 is an exterior perspective view of the expansion unit in FIG. 3.

FIG. 3 is a schematic sectional front view of the expansion unit 1E of the sheet post-processing apparatus 1 in FIG. 1. FIG. 4 is an exterior perspective view of the expansion unit 1E in FIG. 3. As shown in FIG. 1, the expansion unit 1E is disposed above the post-processing main unit 1M. As shown in FIG. 3, the post-processing main unit 1M includes a conveyance switching section 13. As shown in FIGS. 3 and 4, the expansion unit 1E includes a sheet conveyance passage 14, a sheet sorting section 15, a sheet discharge section 16, and a drive section 17. The conveyance switching section 13 is located in a top end part of the post-processing main unit 1M, above the second sheet discharge passage 6. The transport switching section 13 is located upstream of the second discharge port 51 in the sheet conveyance direction in the second sheet discharge passage 6.

In the conveyance switching section 13, a switching guide 13*a* is disposed. With respect to the sheet conveyed along the second sheet discharge passage 6 downstream from the second branch section 2*b*, the switching guide 13*a* can be disposed either in a first position in which it conveys the sheet in a first direction f1 leading to the second sheet discharge section 5 or in a second position in which it conveys the sheet in a second direction f2 leading to the expansion unit 1E. In other words, with respect to the sheet passing through the post-processing main unit 1M, the switching guide 13*a* switches the sheet conveyance direction between the first direction f1 leading to the second discharge tray (main-unit discharge tray) 53 and the second direction f2 leading to the expansion unit 1E.

The sheet conveyance passage 14 extends in the top-bottom direction in the expansion unit 1E. When the expansion unit 1E is mounted on the post-processing main unit 1M, the sheet conveyance passage 14 connects to the conveyance switching section 13. The sheet conveyance passage 14 extends vertically from the conveyance switching section 13 up to a top end part of the expansion unit 1E.

The sheet sorting section 15 is disposed on the sheet conveyance passage 14, downstream of the conveyance switching section 13 in the sheet conveyance direction. In the sheet sorting section 15, a plurality of sorting guides 15*a* are disposed. There are disposed as many sorting guides 15*a* as the number of sheet discharge trays 16*a*, which will be described later, provided in the sheet discharge section 16. In this embodiment, six swing guides 15*a* are disposed corresponding to the second-from-the-top to the bottommost sheet discharge trays 16*a*. If a sheet is not sorted by any of the sorting guides 15*a* up to the top end of the sheet conveyance passage 14, it is discharged to the topmost sheet discharge tray 16*a*.

Each of the six swing guides 15*a* sorts the sheets conveyed along the sheet conveyance passage 14 downstream in the sheet conveyance direction from the conveyance switching section 13 to the sheet discharge tray 16*a* located to the side of the swing guide 15*a*. FIG. 3 shows how a sheet having entered the expansion unit 1E is sorted to the bottommost sheet discharge tray 16*a*.

The sheet discharge section 16 is disposed downstream of the sheet sorting section 15 in the sheet conveyance direction. The sheet discharge section 16 is located above the side face 1*a* of the post-processing main unit 1M. The sheet discharge section 16 has sheet discharge trays 16*a* in multiple stages. In this embodiment, the sheet discharge section 16 has seven sheet discharge trays 16*a*.

The sheet having passed through the post-processing main unit 1M and entered the expansion unit 1E is sorted by the sheet sorting section 15 on the sheet conveyance passage 14 and is discharged to one of the seven sheet discharge trays 16*a*. The sheet discharge trays 16*a* are one of final discharge locations for sheets that have been post-processed by the sheet post-processing apparatus 1.

The drive unit 17 is disposed in an end part in the sheet width direction (paper depth direction in FIG. 3), which is orthogonal to the sheet conveyance direction in the sheet conveyance passage 14. The drive section 17 has pulleys 17*a*, a belt 17*b*, a pressing piece 17*c*, a plurality of sorting swing pieces 17*d*, a switching swing piece 17*e*, and a guide contact member 17*f*.

The pulleys 17*a* are disposed at two locations, at the top and at the bottom of the expansion unit 1E. Each of the two pulleys 17*a* is supported on a shaft 17*ax* extending in the sheet width direction and can rotate about the axis of the shaft 17*ax*. One of the two pulleys 17*a* is connected to a motor (not shown) and is rotated by the motor. The operation of the motor is controlled by the post-processing control unit 12 or the image forming control unit in the image forming apparatus 201.

The belt 17*b* is formed in a ring shape and is wound around the two pulleys 17*a*. In other words, the belt 17*b* describes an oval extending in the top-bottom direction. The belt 17*b* is rotated along the circumferences of the two pulleys 17*a* by the motor connected to the pulleys 17*a*.

The pressing piece 17*c* is fixed to the outer circumference of the belt 17*b* and protrudes outward of the belt 17*b*. The pressing piece 17*c* moves along the track of the belt 17*b* as the belt 17*b* rotates. As it moves, the pressing piece 17*c* makes contact with and displaces each of the sorting swing piece 17*d* and the switching swing piece 17*e*

The plurality of sorting swinging pieces 17*d* are each disposed on the track of the pressing piece 17*c*, which moves with the rotation of the belt 17*b*. In this embodiment, as the plurality of sorting swing pieces 17*d*, six of them are disposed corresponding to the number of sorting guides 15*a*. That is, six pairs of a sorting swing piece 17*d* and a sorting guide 15*a* are disposed. The six sorting swing pieces 17*d*, corresponding to the six sorting guides 15*a*, are disposed one above another in the top-bottom direction along the sheet conveyance passage 14. Each pair of a sorting swing piece 17*d* and a sorting guide 15*a* is supported on a shaft 17*dx* extending in the sheet width direction and is swingable (rotatable) about the axis of the shaft 17*dx*.

The sorting swing piece 17*d* is urged by a spring (not shown) or by the action of gravity so that the sorting guide 15*a* is disposed in such a position that the sheet is conveyed vertically upward along the sheet conveyance passage 14. When the sheet is sorted to the corresponding sheet discharge tray 16*a*, the pressing piece 17*c*, which moves together with the belt 17*b*, makes contact with the sorting swing piece 17*d*, and the sorting swing piece 17*d* is displaced against the urging force so that the sorting guide 15*a* is disposed in such a position as to sort the sheet to the sheet discharge tray 16*a*.

The switching swing piece 17*e* is disposed below the lower pulley 17*a*. The switching swing piece 17*e* is disposed on the track of the pressing piece 17*c*, which moves with the rotation of the belt 17*b*. The switching swing piece 17*e* is supported on a shaft 17*ex* extending in the sheet width direction and is rotatable about the axis of the shaft 17*ex*. The switching swing piece 17*e* has, radially outward of the shaft 17*ex*, a coupling portion 17*cc* to which the guide contact member 17*f* is rotatably coupled.

The switching swing piece 17*e* is urged by a spring (not shown) so that the guide contact member 17*f* coupled to the coupling portion 17*ec* is disposed in an upper position. When the expansion unit 1E is mounted on the post-processing main unit 1M and a sheet passing inside the post-processing main unit 1M is discharged to the second sheet discharge section 5, the pressing piece 17*c*, which moves together with the belt 17*b*, makes contact with the switching swing piece 17*e*, and the switching swing piece 17*e* is displaced against the urging force so that the guide contact member 17*f* is disposed in a lower position.

The guide contact member 17*f* is disposed below the switching swing piece 17*e*, in a bottom end part of the expansion unit 1E. The guide contact member 17*f* is formed as a rod extending generally in the top-bottom direction and is coupled at a top end part of it to the coupling portion 17*ec* of the switching swing piece 17*e*. The guide contact member 17*f* is disposed either in an upper position or in a lower position, which is below the upper position, as the switching swing piece 17*e* swings about the axis of the shaft 17*ex*.

A bottom part of the guide contact member 17*f* protrudes through a hole 1Eh in the bottom plate 1Eb of the expansion unit 1E to below the bottom plate 1Eb. A bottom end part of the guide contact member 17*f* makes contact with the switching guide 13*a* when the expansion unit 1E is mounted on the post-processing main unit 1M.

Figure 5:
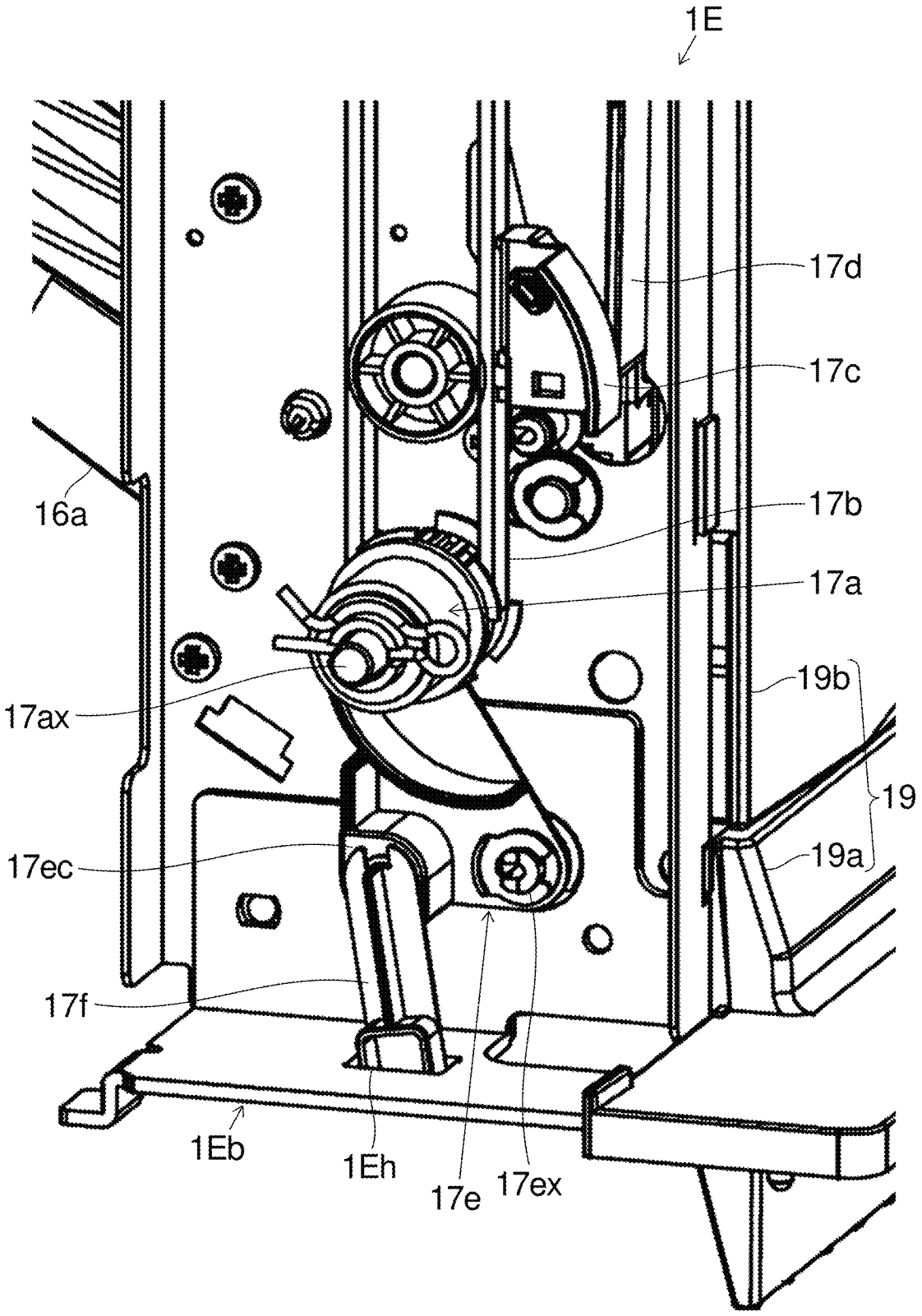
FIG. 5 is a perspective part view around a guide contact member in the expansion unit in FIG. 4 as observed when a sheet is discharged from the expansion unit.
Figure 6:
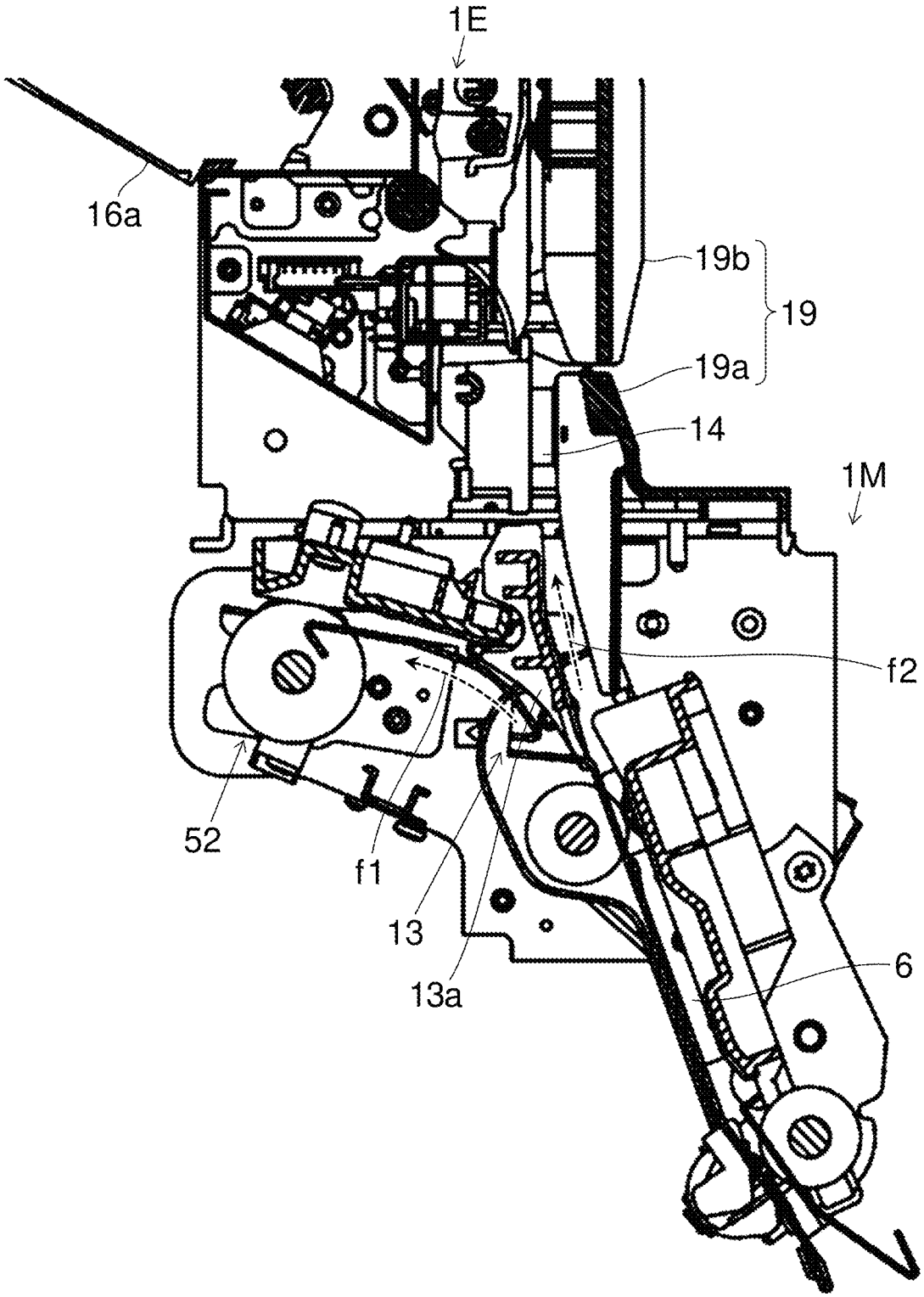
FIG. 6 is a sectional front view around a switching guide in the sheet post-processing apparatus in FIG. 3 as observed when a sheet is discharged from the expansion unit.
Figure 7:
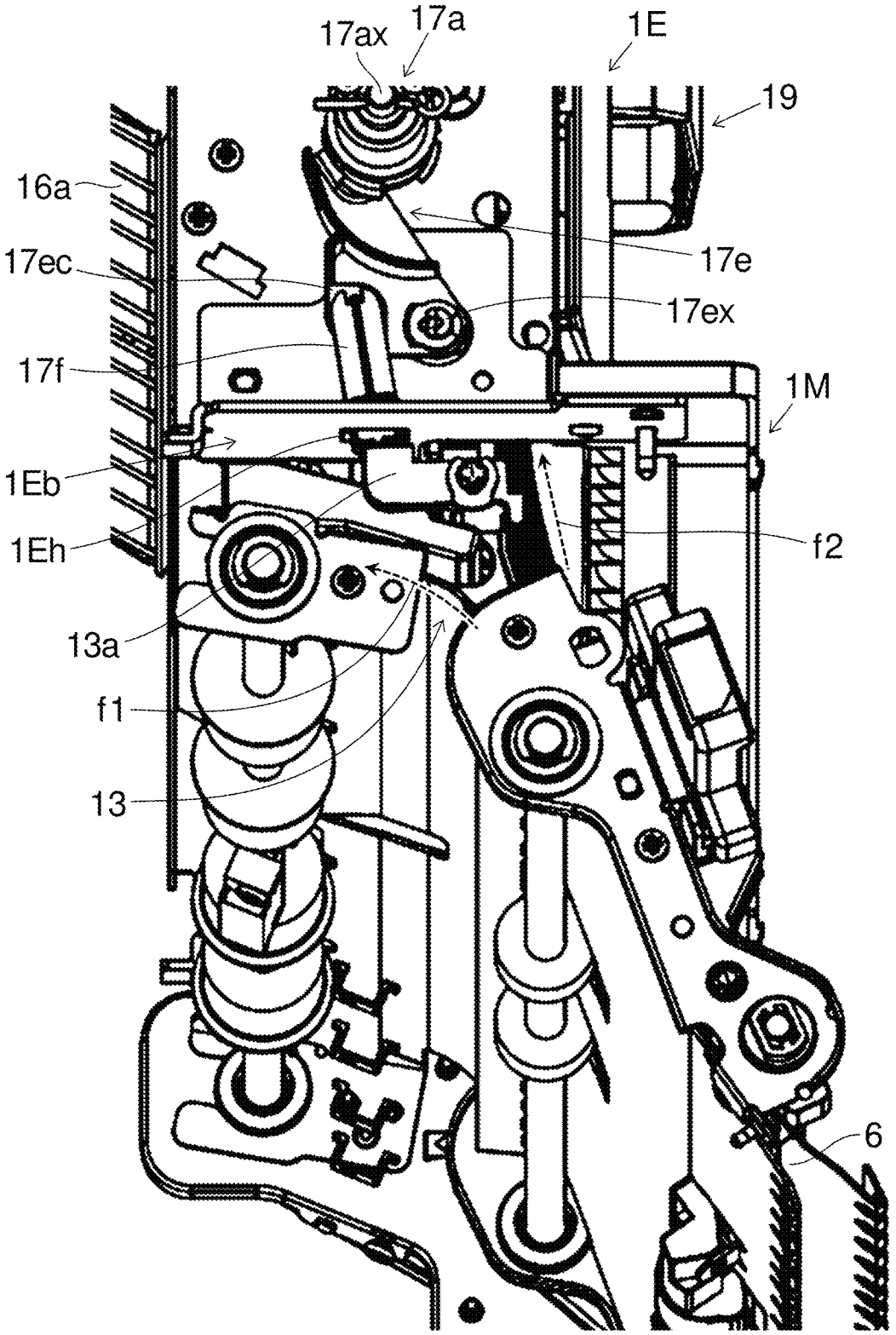
FIG. 7 is a perspective part view around the switching guide in FIG. 6.
Figure 8:
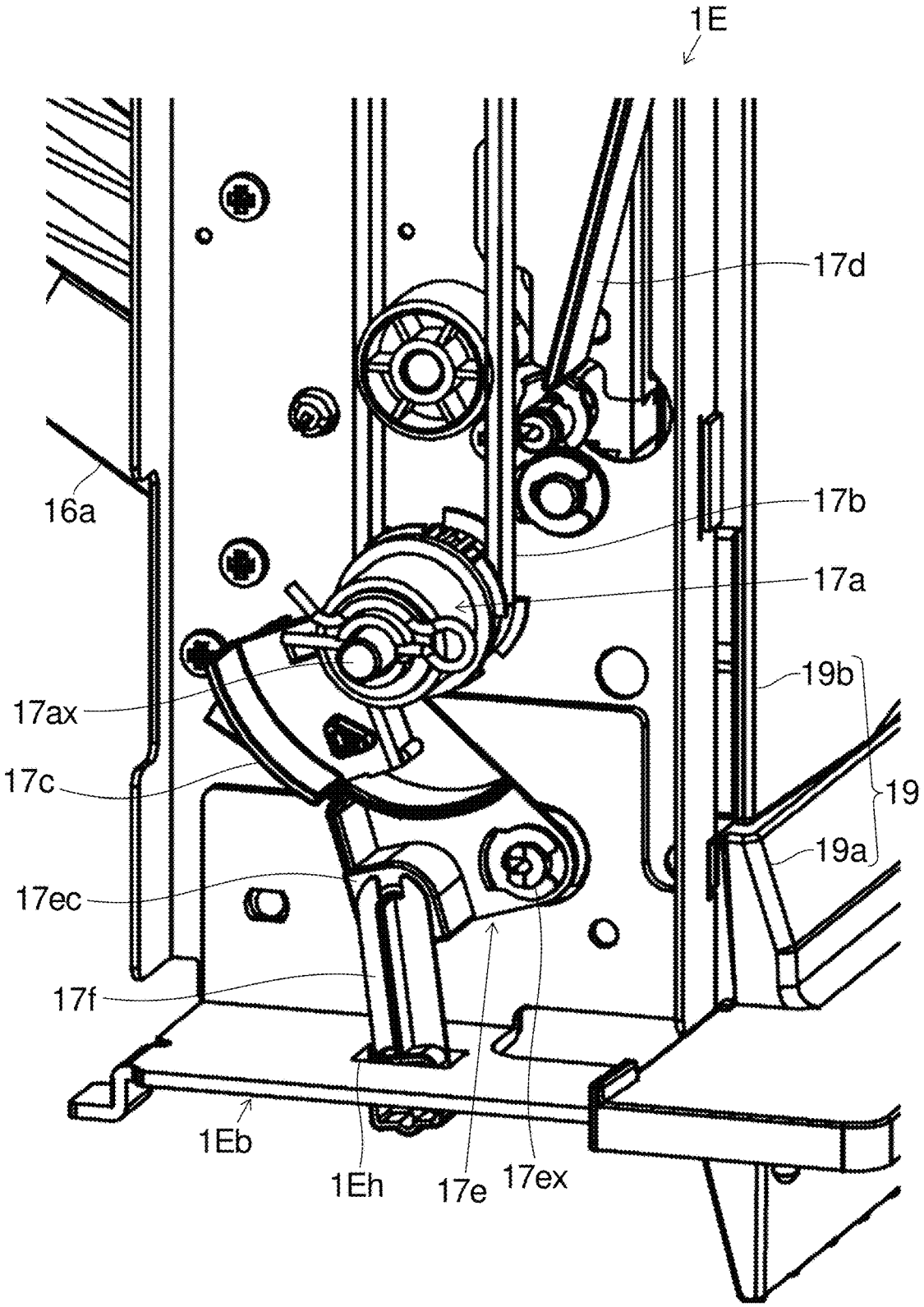
FIG. 8 is a perspective part view around the guide contact member in the expansion unit in FIG. 4 as observed when a sheet is discharged from the post-processing main unit.
Figure 9:
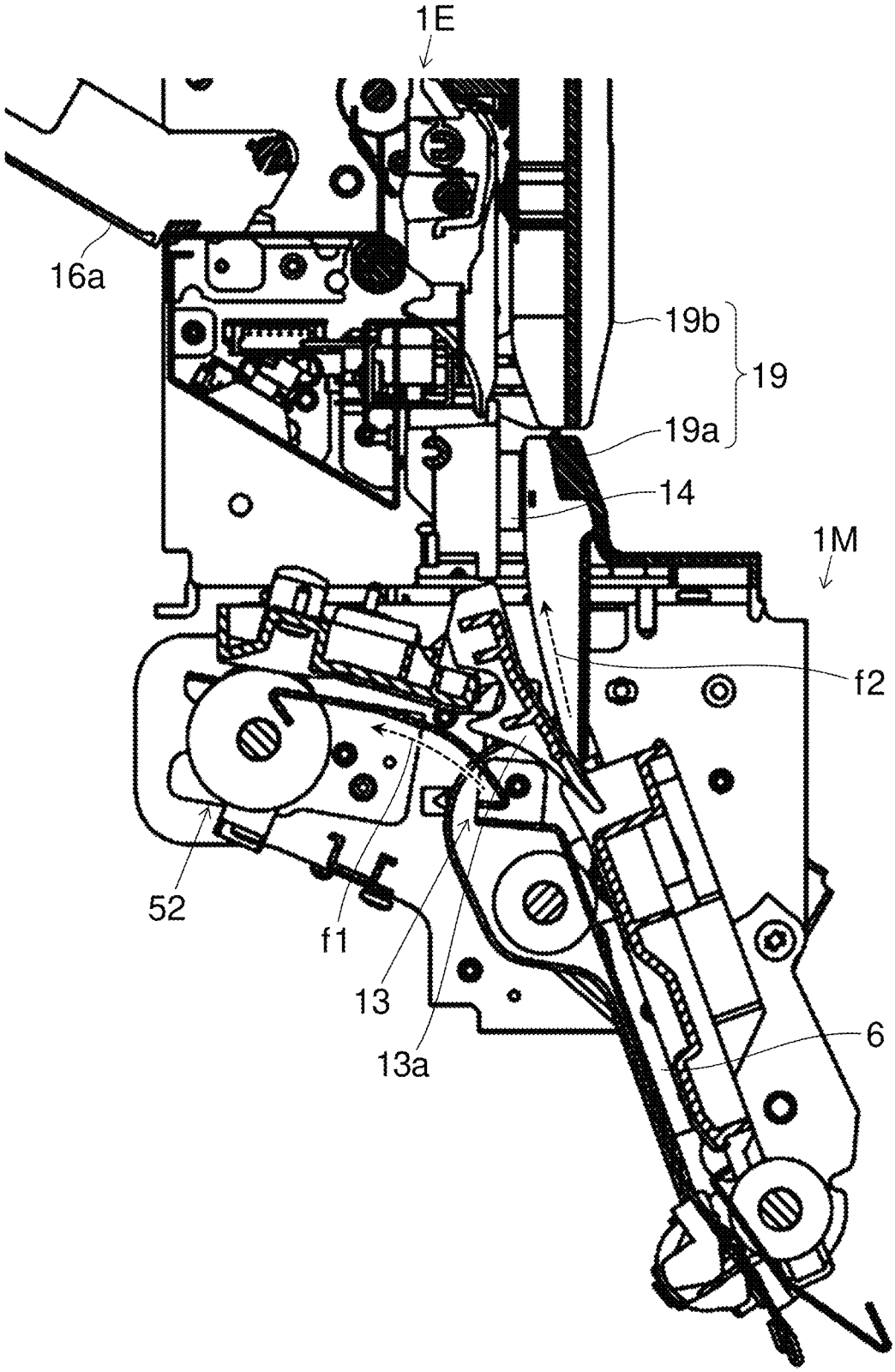
FIG. 9 is a sectional front view around the switching guide in the sheet post-processing apparatus in FIG. 3 as observed when a sheet is discharged from the post-processing main unit.
Figure 10:
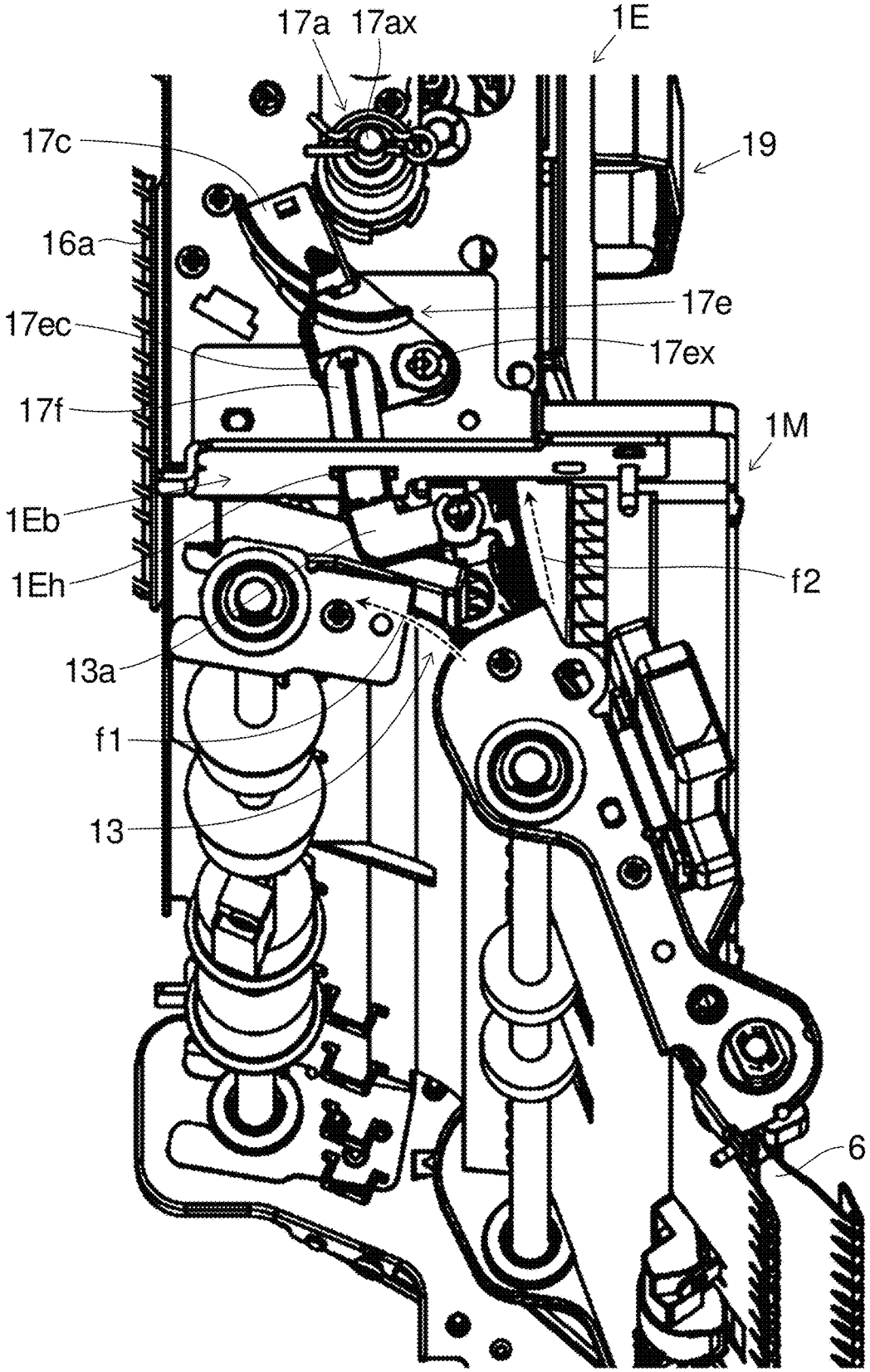
FIG. 10 is a perspective part view around the switching guide in FIG. 9.

Next, the movement of the switching guide 13*a* will be described with reference to FIGS. 5 to 10. FIGS. 5 and 6 are, respectively, a perspective part view around the guide contact member 17*f* in the expansion unit 1E in FIG. 4 and a sectional front view around the switching guide 13*a* in the sheet post-processing apparatus 1 in FIG. 3 as observed when a sheet is discharged from the expansion unit 1E. FIG. 7 is a perspective part view around the switching guide 13*a* in FIG. 6. FIGS. 8 and 9 are, respectively, a partial perspective view around the guide contact member 17*f* in the expansion unit 1E in FIG. 4 and a sectional front view around the switching guide 13*a* in the sheet post-processing apparatus 1 in FIG. 3 as observed when a sheet is discharged from the post-processing main unit 1M. FIG. 10 is a perspective part view around the switching guide 13*a* in FIG. 9.

FIGS. 5, 6, and 7 show a state where the expansion unit 1E is mounted on the post-processing main unit 1M and where sheets passing through the post-processing main unit 1M are directed to the expansion unit 1E. Note that FIG. 5 shows no part of the post-processing main unit 1M and FIGS. 6 and 7 do not show some components of the post-processing main unit 1M are not shown.

When a sheet passing through the post-processing main unit 1M is directed to the expansion unit 1E, as shown in FIGS. 5 and 7, the pressing piece 17*c* fixed to the belt 17*b* is separated from the switching swing piece 17*e*. For example, as shown in FIG. 5, the pressing piece 17*c* makes contact with the bottommost sorting swing piece 17*d* and displaces the swinging piece 17*d* so that the swinging guide 15*a* is disposed in such a position as to sort the sheet to the bottommost sheet discharge tray 16*a* (here, FIGS. 3 and 4).

With the pressing piece 17*c* separated from the switching swing piece 17*e*, the switching swing piece 17*e* rotates clockwise in FIG. 5 under the urging force of a spring (not shown) to pull up the guide contact member 17*f*. In this way, the contact member 17*f* is disposed in the upper position.

With the expansion unit 1E mounted on the post-processing main unit 1M, the bottom end part of the guide contact member 17*f* makes contact with the switching guide 13*a* in the conveyance switching section 13. Here, the switching guide 13*a* is urged with a spring (not shown) or by the action of gravity so as to be disposed in the second position in which it directs the sheets passing through the post-processing main unit 1M to the expansion unit 1E.

With the guide contact member 17*f* disposed in the upper position, the guide contact member 17*f* exerts no force that pushes the switching guide 13*a* downward. Thus, as shown in FIGS. 6. and 7, urged with the spring or by the action of gravity, the switching guide 13*a* is disposed in the second position in which it conveys the sheets passing through the post-processing main unit 1M in the second direction f2 leading to the expansion unit 1E.

FIGS. 8, 9, and 10 show a state where the expansion unit 1E is mounted on the post-processing main unit 1M and where sheets passing through the post-processing main unit 1M are directed to the second sheet discharge section (main-unit discharge tray) 5. Note that FIG. 8 shows no part of the post-processing main unit 1M and FIGS. 9 and 10 do not show some components of the post-processing main unit 1M.

When a sheet passing through the post-processing main unit 1M is directed to the second sheet discharge section 5, as shown in FIGS. 8 and 10, the pressing piece 17*c* fixed to the belt 17*b* makes contact with the switching swing piece 17*e*. With the pressing piece 17*c* in contact with the switching swing piece 17*e*, under a force received from the contacting pressing piece 17*c* with which it is in contact, the switching piece 17*e* rotates counter-clockwise in FIG. 5 to push the guide contact member 17*f* downward. Thus, the guide contact member 17*f* is disposed in the lower position.

With the guide contact member 17*f* disposed in the lower position, the guide contact member 17*f* exerts a force that pushes the switching guide 13*a* downward. Thus, as shown in FIGS. 9 and 10, the switching guide 13*a* is disposed in the first position against the urging force from the spring or by the action of gravity to convey the sheet passing through the post-processing main unit 1M in the first direction f1 leading to the second sheet discharge tray 53.

With the above configuration, the sheet post-processing apparatus 1 includes, in the post-processing main unit 1M, a switching guide 13*a* that directs sheets from the post-processing main unit 1M to the expansion unit 1E. This eliminates the need to provide a switching guide 13 for each of various types of expansion units 1E that can be mounted on the post-processing main unit 1M and helps reduce the cost of the expansion unit 1E. The low-cost configuration helps enhance the functionality of the sheet post-processing apparatus 1.

Figure 11:
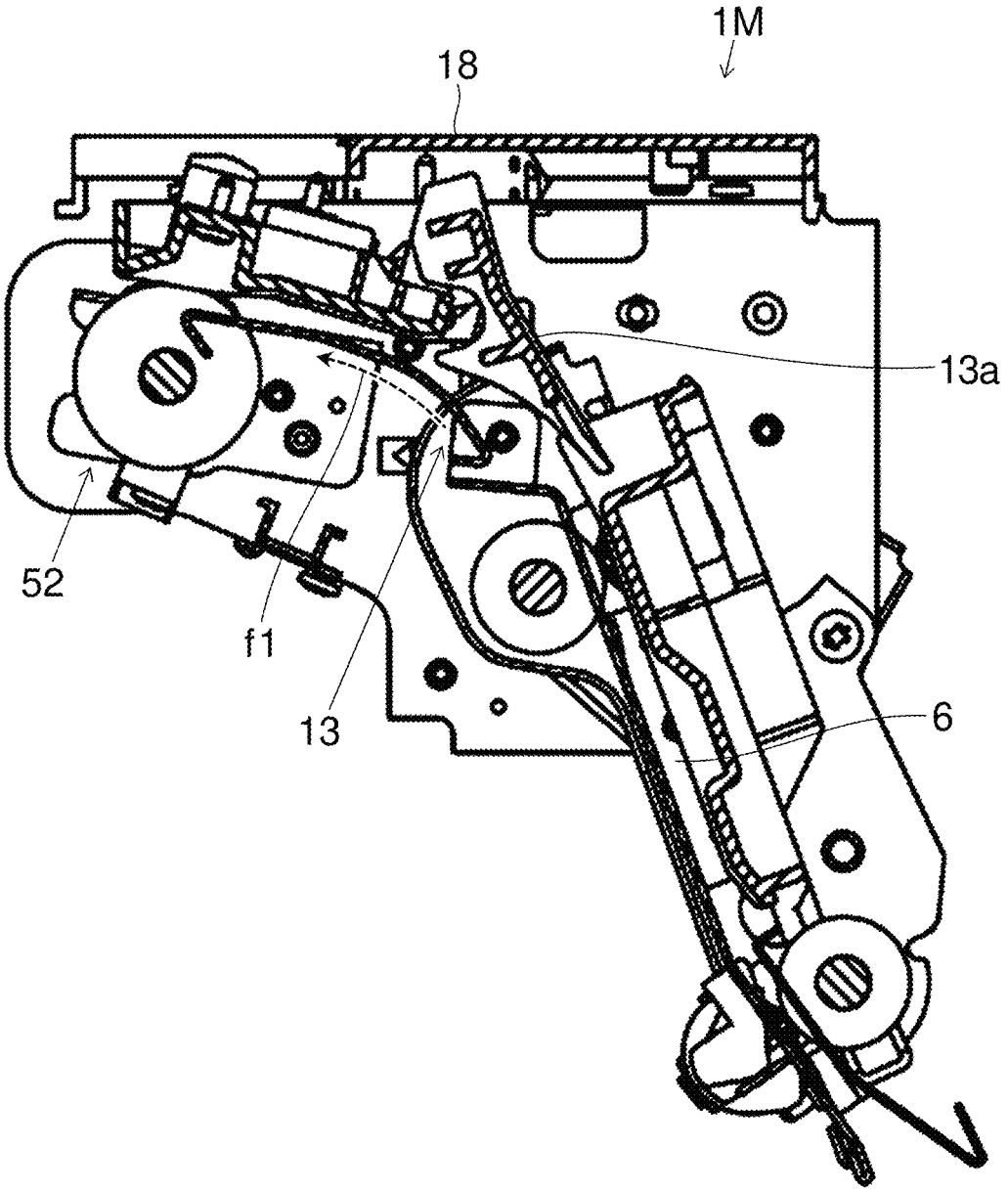
FIG. 11 is a sectional front view around the switching guide in the sheet post-processing apparatus with a cover member fitted on it.
Figure 12:
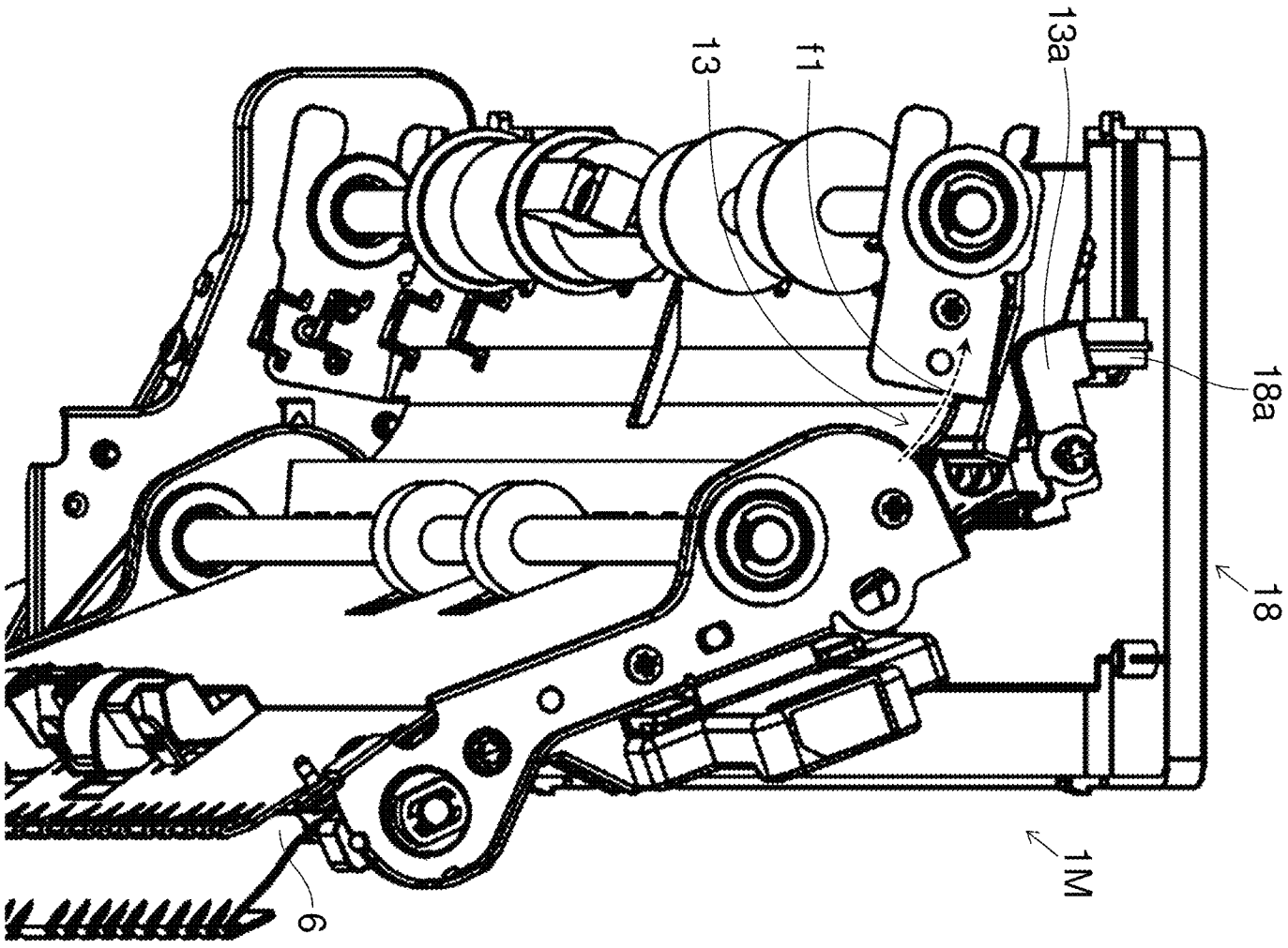
FIG. 12 is a perspective part view around the switching guide in FIG. 11.

Also, the post-processing main unit 1M includes a cover member 18 as shown in FIGS. 11 and 12. FIG. 11 is a sectional front view around the switching guide 13*a* in the sheet post-processing apparatus 1 with the cover member 18 fitted on it. FIG. 12 is a perspective part view around the switching guide 13*a* in FIG. 11.

The cover member 18 is disposed in a top end part of the post-processing main unit 1M. The cover member 18 is formed in the shape of a flat plate extending in a horizonal direction and covers the top end part of the post-processing main unit 1M. The cover member 18 is removably fitted to the top end part of the post-processing main unit 1M in place of the expansion unit 1E when this is not mounted. The cover member 18 has a guide regulation portion 18*a*.

The guide regulation portion 18*a* is disposed on the bottom surface of the cover member 18 and is formed as a projection protruding downward. The guide regulation portion 18*a* is disposed at the same position where the guide contact member 17*f* is disposed when the expansion unit 1E is mounted on the post-processing main unit 1M. Specifically, the guide regulation portion 18*a* is disposed at the same position (FIGS. 8, 10) where the guide contact member 17*f* is disposed when pushed below by the pressing piece 17*c* and disposed in the lower position.

As shown in FIG. 12, the guide regulation portion 18*a* makes contact with the switching guide 13*a* when the cover member 18 is fitted to the post-processing main unit 1M. Thus, as shown in FIGS. 11 and 12, the switching guide 13*a* is disposed in the first position against the urging force from the spring or by the action of gravity to convey the sheet passing through the post-processing main unit 1M in the first direction f1 leading to the second discharge tray 53. In this way, the guide regulation portion 18*a* changes the position of the switching guide 13*a* to the first direction in which it guides the sheet to the second discharge tray 53.

In the above configuration, disposing the cover member 18 covering the top end part of the post-processing main unit 1M on the post-processing main unit 1M allows the switching guide 13*a* to be automatically disposed in the first position in which it conveys the sheets in the first direction f1 leading to the second discharge tray 53. This eliminates the need to provide a component that drives the switching guide 13*a* and helps reduce the cost of post-processing main unit 1M. The low-cost configuration helps enhance the functionality of the sheet post-processing apparatus 1.

With reference back to FIGS. 3 and 4, the expansion unit 1E includes a conveyance guide 19. The conveyance guide 19 is disposed on the side face of the expansion unit 1E facing the image forming apparatus 201, opposite from the side face on which the sheet discharge section 16 is disposed. The conveyance guide 19 is an exterior member covering the side face of the expansion unit 1E and is formed in the shape of a flat plate extending in the top-bottom and front-back directions. The conveyance guide 19 on its inner surface guides a sheet being conveyed in the sheet conveyance passage 14.

As shown in FIGS. 3 and 6, part of a bottom portion of the conveyance guide 19 is inserted into the post-processing main unit 1M when the expansion unit 1E is mounted on the post-processing main unit 1M. When the expansion unit 1E is mounted on the post-processing main unit 1M, the conveyance guide 19 faces the switching guide 13*a* across the conveyance passage of the sheet conveyed in the second direction f2.

With the above configuration, there is no need to provide a conveyance guide in the post-processing main unit 1M with respect to the conveyance passage for sheets conveyed in the second direction f2 in the conveyance switching section 13. This helps reduce the cost of the post-processing main Unit 1M.

The conveyance guide 19 has a fixed guide portion 19*a* and a movable guide portion 19*b*. The fixed guide section 19*a* and the movable guide section 19*b* are continuously disposed one above the other in the top-bottom direction.

The fixed guide section 19*a* is disposed in a bottom part of the expansion unit 1E and is located below the movable guide section 19*b*. The fixed guide portion 19*a* is inserted into the post-processing main unit 1M when the expansion unit 1E is mounted on the post-processing main unit 1M. The fixed guide portion 19*a* extends out of the post-processing main unit 1M into the expansion unit 1E.

With the above configuration, a sheet conveyed toward the expansion unit 1E can be smoothly conveyed from inside the post-processing main unit 1M to inside the expansion unit 1E. Thus, it is possible to suppress the occurrence of sheet jams and other problems at the connection portion between the post-processing main unit 1M and the expansion unit 1E.

The movable guide section 19*b* is disposed in a top part of the expansion unit 1E and is located above the fixed guide section 19*a*. As shown in FIG. 3, the movable guide portion 19*b* is supported on a shaft 19*bx* disposed in an upper end part and extending in the sheet width direction and is rotatable about the axis of the shaft 19*bx*. The movable guide portion 19*b* is openable and closable by rotating about the axis of the shaft 19*bx* so as to expose the sheet conveyance passage 14 in the expansion unit 1E.

With the above configuration, the sheet conveyance passage 14 can be exposed, allowing easy access to the sheet conveyance passage 14 and the sheet sorting section 15. This makes it easy to maintain the sheet conveyance passage in the expansion unit 1E and to troubleshoot problems.

Moreover, the expansion unit 1E has sheet discharge trays 16*a* in multiple stages to which the sheets entering from the post-processing main unit 1M are sorted and discharged. As described above, in this embodiment, the expansion unit 1E has seven sheet discharge trays 16*a*. That is, the expansion unit 1E of this embodiment is a unit equipped with a function called a mailbox having sheet discharge trays in multiple stages disposed one above another in the top-bottom direction. Thus, according to this embodiment, it is possible to reduce the number of components in the expansion unit 1E having the function of a mailbox and thereby to reduce costs.

The embodiment of the present disclosure described above is not meant to limit the scope of the present disclosure, which thus allows for any modifications without departure from the spirit of the present disclosure.

For example, while in the above embodiment the expansion unit 1E is a unit equipped with the function of a mailbox having sheet ejection trays in multiple stages, this is not meant as any limitation to such an apparatus. The expansion unit may be a unit having any function other than that of a mailbox.

What is claimed is:

1. A sheet post-processing apparatus comprising:

a post-processing main unit that performs predetermined post-processing on a sheet and discharges the sheet to a main-unit discharge tray; and an expansion unit into which the sheet having passed through the post-processing main unit is introduced, the expansion unit being removably mounted on the post-processing main unit, wherein the post-processing main unit includes a switching guide that switches a conveyance direction of the sheet passing through the post-processing main unit between a first direction leading to the main-unit discharge tray and a second direction leading to the expansion unit, and the expansion unit includes a guide contact member that, when the expansion unit is mounted on the post-processing main unit, makes contact with the switching guide to switch the switching guide to a position for the second direction.

2. The sheet post-processing apparatus according to claim 1, wherein the post-processing main unit includes a cover member removably fitted on the post-processing main unit in place of the expansion unit when the expansion unit is not mounted, the cover member has a guide regulating section that makes contact with the switching guide when the cover member is fitted on the post-processing main unit to switch the switching guide to a position for the first direction.

3. The sheet post-processing apparatus according to claim 1, wherein the expansion unit includes a conveyance guide that, when the expansion unit is mounted on the post-processing main unit, faces the switching guide across a conveyance passage of the sheet conveyed in the second direction.

4. The sheet post-processing apparatus according to claim 3, wherein the conveyance guide includes:

a fixed guide portion that, when the expansion unit is mounted on the post-processing main unit, is inserted into the post-processing main unit; and a movable guide portion that is openable and closable and that can expose a sheet conveyance passage in the expansion unit.

5. The sheet post-processing apparatus according to claim 4, wherein the fixed guide section extends out of the post-processing main unit into the expansion unit.

6. The sheet post-processing apparatus according to claim 1, wherein the expansion unit has sheet discharge trays in multiple stages to which the sheet having entered from the post-processing main unit is sorted and discharged.

7. An image forming system comprising:

an image forming apparatus that forms an image on a sheet; and the sheet post-processing apparatus according to claim 1 that performs predetermined post-processing on the sheet having the image formed thereon in the image forming apparatus.

* * * * *